US008632655B2

(12) United States Patent
Vehmaa et al.

(10) Patent No.: US 8,632,655 B2
(45) **Date of Patent: *Jan. 21, 2014**

(54) METHOD IN CONNECTION WITH THE WASHING OF PULP AT A CHEMICAL PULP MILL

(75) Inventors: Janne Vehmaa, Siltakylä (FI); Olavi Pikka, Kotka (FI); Pekka Tervola, Espoo (FI)

(73) Assignee: Andritz Oy, Helsinki (FI)

( * ) Notice: Subject to any disclaimer, the term of this patent is extended or adjusted under 35 U.S.C. 154(b) by 632 days.

This patent is subject to a terminal disclaimer.

(21) Appl. No.: 12/664,425

(22) PCT Filed: Jun. 12, 2008

(86) PCT No.: PCT/FI2008/000063

§ 371 (c)(1),
(2), (4) Date: Jun. 4, 2010

(87) PCT Pub. No.: WO2008/152185

PCT Pub. Date: Dec. 18, 2008

(65) Prior Publication Data

US 2010/0243183 A1 Sep. 30, 2010

(30) Foreign Application Priority Data

Jun. 15, 2007 (FI) ..... 20070477
Feb. 22, 2008 (FI) ..... 20080144

(51) Int. Cl.
*D21C 11/00* (2006.01)

(52) U.S. Cl.
CPC ..... *D21C 11/0028* (2013.01)
USPC ..... 162/29

(58) Field of Classification Search
CPC ..... D21C 11/0028
USPC ..... 162/29
See application file for complete search history.

(56) References Cited

U.S. PATENT DOCUMENTS 4,188,260 A * 2/1980 Rowlandson et al. ..... 162/16
4,490,257 A 12/1984 Becker
5,126,009 A 6/1992 Berry et al.
5,127,992 A * 7/1992 Davies et al. ..... 162/29
5,525,195 A 6/1996 Friend et al.
5,785,810 A 7/1998 Salminen
6,569,284 B1 5/2003 Yin et al.
2004/0244925 A1 12/2004 Tarasenko

FOREIGN PATENT DOCUMENTS

| | | |
|---|---|---|
| CN | 1247248 | 3/2000 |
| CN | 1616761 | 5/2005 |
| CN | 1931749 | 3/2007 |
| EP | 0 540 091 A1 | 5/1993 |
| JP | 05-195466 | 8/1993 |
| JP | 2001-115382 | 4/2001 |
| WO | 91/17307 | 11/1991 |
| WO | 94/03673 | 2/1994 |
| WO | 94/20675 | 9/1994 |
| WO | 02/14600 | 2/2002 |

OTHER PUBLICATIONS

POYRY corporation, Gunns Bell Bay Pulp Mill reports: Overview of Pulp Mill Processes [downloaded from web.archive.org], May 27, 2007 [downloaded on Jun. 13, 2012], Poyry.*
POYRY corporation, Gunns Bell Bay Pulp Mill reports: Overview of Pulp Mill Processes [downloaded from web.archive.org], May 27, 2007 [downloaded on Jan. 28, 2013], Poyry.*
Duran et al., A new alternative for Kraft E1 effluent treatment, 1994, Biodegrerdation 5, p. 13-19.*
International Search Report mailed Jan. 12, 2009.
Minna Viirimaa et al., "Identification of the Wash Loss Compounds Affecting the ECF Bleaching of Softwood Kraft Pulp", Appita Journal, vol. 55, No. 6, pp. 484-488, Nov. 2002.

* cited by examiner

*Primary Examiner* — Anthony J Calandra
(74) *Attorney, Agent, or Firm* — Nixon & Vanderhye P.C.

(57) ABSTRACT

A method in connection with washing of pulp at a chemical pulp mill including at least an alkaline cooking process utilizing cooking liquor for producing pulp, brown stock treatment with essentially closed liquid cycles, in which the last washing device is a washing device based on pressing of pulp, a press or a washing press, a pulp bleaching plant using ECF-bleaching, wherein chloride-containing effluents are formed, a chemical recovery plant and effluent purification. The liquid flows generated at a chemical pulp mill are efficiently circulated without disturbing the main process and minimizing the emissions from the mill. Purified effluent in the amount of at least 1 m3/adt pulp is introduced into the dilution after the press or washing press, whereby the effluent is passed from the dilution into the first process stage of the bleaching.

14 Claims, No Drawings

METHOD IN CONNECTION WITH THE WASHING OF PULP AT A CHEMICAL PULP MILL

This application is the U.S. national phase of International Application No. PCT/FI2008/000063 filed 12 Jun. 2008 which designated the U.S. and claims priority to Finnish Patent Application Nos. 20080144 filed 22 Feb. 2008 and 20070477 filed 15 Jun. 2007, the entire contents of each of which applications are hereby incorporated by reference.

BACKGROUND OF THE INVENTION

The present invention relates to a method in connection with the washing of pulp at a chemical pulp mill comprising at least an alkaline cooking process utilizing cooking liquor for producing pulp, brown stock treatment with essentially closed liquid cycles, in which a last washing device is washing device based on pressing of pulp, a press or a washing press, a pulp bleaching plant using ECF-bleaching, wherein chloride-containing effluents are formed, a chemical recovery plant and effluent purification.

The size of pulp mills has grown intensively during the last years, as today a pulp mill producing 1 million ton/a is of normal size and it does not seem that the growth of the size of pulp mills would be ceasing. At the same time that the size of the pulp mills is growing, the mills are being built in areas and surroundings with very strict environmental regulations. For example, the amount of water used by a mill is strongly restricted. Because the size of the mill grows, minor decreases in the water amounts used by the mill per one ton of pulp do not absolutely decrease the amount of water used by the mill, but the amount is compensated back to the same level as the production size increases. This development is difficult especially in countries where the mill simply does not have enough water available or the water resources should be saved for the needs of people and cultivation. In this kind of situation it is simply impossible to build a mill at a place where other demands of production are easily fulfilled, but due to water resources it is not possible to build a mill. Additionally, in many areas a cleaner environment is desired in such a way that the mills produce substances that are less detrimental to the environment. Therefore, it is essential to look for solutions for finding an increasingly closed process.

Chlorine-containing chemicals have been used throughout the production of chemical pulp in several different forms, of which elemental chlorine $Cl_2$, chlorine dioxide $ClO_2$ and hypochlorite NaOCl or CaOCl are the best known. Chlorine-containing chemicals have been used also e.g. in the form of hypochlorous acid in bleaching, but no permanent applications remained in use. On the other hand, the chemical pulp industry desired to tightly maintain a technique in which pulp is bleached with chlorine-containing chemicals so that chlorine dioxide is the main chemical of the bleaching process of the mill. Years-long pressure to reduce the amount of organic chlorine compounds in bleaching effluents has led to the point that first the use of chlorine and hypochlorite was abandoned and further the kappa number of the pulp after digestion was decreased from level 30 to level 10-15 for soft wood and from level 16-20 to level 10-13 for hard wood using an oxygen stage. In 1990s, the aim was to abandon the use of chlorine dioxide as well and many mills switched to the use of total chlorine free (TCF) bleaching technique, wherein the use of chlorine dioxide, too, was replaced by totally chlorine-free bleaching chemicals, such as ozone and peroxide. With this technique, the mills got rid of all chlorine-containing chemicals, but on the other hand many paper producers were unsatisfied with the properties of pulp produced without chlorine chemicals. Therefore, the marginal term for all solutions relating to the closing of the mill is that chlorine dioxide is still used as bleaching chemical.

Thus the dominating position of chlorine dioxide as bleaching chemical has even gained more power during the last years, and not even the latest researches or industrial experiences have managed to destabilize its position, but as a rule the whole pulp industry, with only a few exceptions, has approved the use of chlorine dioxide as the key chemical in bleaching. Thus, if a mill is to further decrease the amount of organic chlorine compounds, the aim of the mills will be, first and foremost, to eliminate them and to treat them inside the mill, rather than to decrease the use of chlorine dioxide.

Modern ECF-bleaching used for bleaching pulp, is typically formed of at least three bleaching stages and three washing apparatuses. In a special case there may be only two washing apparatuses, but such applications are rare. ECF-bleaching covers all such bleaching sequences, which have at least one chlorine dioxide stage and which do not use elemental chlorine in any bleaching stage. Because the use of hypochlorite is due to pulp quality reasons restricted to the production of only a few special pulps, such as dissolving pulps, also hypochlorite is not regarded to be used in the production of ECF-pulp, but it is not totally ruled out. Additionally, the bleaching sequence comprises one alkaline stage, wherein the additional chemicals used are today typically either oxygen, peroxide or both. Further, modern bleachings may use ozone, various types of acid stages and a chelate stage for removing heavy metals. In literature, the bleaching stages are described with letters:

O=oxygen delignification
D=chlorine dioxide stage
H=hypochlorite stage
C=chlorination stage
E=alkaline extraction stage
EO=alkaline extraction stage using oxygen as additional chemical
EO=alkaline extraction stage using peroxide as additional chemical
EOP(PO)=alkaline extraction stage using oxygen and peroxide as additional chemical
P=alkaline peroxide stage
A=acid hydrolysis stage, stage of removal of hexenuronic acids
a=pulp acidation stage
Z=ozone stage
PAA=peracetic acid stage, acid peroxide stage In this patent application the chemical amount and other amounts are given per one ton of air dry pulp (adt pulp, i.e. air dry metric ton of 90% dry chemical pulp).

When bleaching is called ECF-bleaching, the amount of chlorine dioxide used in the bleaching sequence is more than 5 kg act.Cl/adt pulp. If chlorine dioxide is used in one bleaching stage, most typically the doses are between 5-15 kg act. Cl/adt. The doses refer to active chlorine, whereby when converting to chlorine dioxide the dose has to be divided by a ratio of 2.63.

If the use of peroxide in bleaching is restricted to doses smaller than 6 kg and if chlorine dioxide is the main bleaching chemical, so then the chlorine dioxide dose in the bleaching increases from a level of 25 kg/adt depending on the bleaching properties of the pulp and on how much the kappa number of the pulp has been decreased before starting the bleaching using chlorine-containing chemicals. Thus, the bleaching technique may in view of the process be fairly freely adjusted to various levels of chlorine dioxide consumption so that the amount of chlorine-containing chemicals exiting the bleaching corresponds to the capacity of the chemical cycle to receive chlorides.

In connection with the present invention it is in view of practice most preferable to choose as reference sequence for hard wood a bleaching sequence A/D-EOP-D-P effected with four bleaching stages and leave ozone out. The corresponding sequence for soft wood is D-EOP-D-P. Then the quality of the pulp can be regarded to correspond to the qualities required from ECF-pulp and the pulp yield remains reasonable. Then the chlorine dioxide doses for soft wood are typically between 25-35 kg/adt pulp and for hard wood 20-30 kg/adt. These values can be regarded as measuring values, and there is no need to invent any new specific techniques for bleaching. The theory of bleaching and various connection alternatives render a possibility for countless different bleaching sequences starting from the connection of two washing apparatuses up to six-stage bleaching sequences. At the same time, the number of chlorine dioxide stages may vary from one up to four and therebetween are alkaline stages as appropriate.

When the amount of active chlorine is calculated as described above in form of the chloride amount, it is noted that even with soft wood, for obtaining a good bleaching result, the bleaching line produces about 10 kg of chlorides per one ton of pulp and a hard wood bleaching line even less. If the plant is closed such that less and less of fresh water is led into bleaching, there may be a need to prepare for chlorine dioxide doses of even 50% greater, and on the other hand the amount of chlorides in bleaching effluents increases up to a level of approximately 15 kg, meaning that in practice the greatest doses of active chlorine are 60-70 kg/adt. Values higher than this cannot be considered economically reasonable, but the basic bleaching solution complies with these starting points.

One suggested technique for decreasing the environmental effects of chlorine-containing chemicals is the closing of the liquid cycles of bleaching plants, and modern bleaching plants have reached to a level of 10-15 $m^3$ of effluent/adt pulp without a decrease in pulp quality. Nevertheless, even when decreasing the amount of bleaching effluent from a level of 15 $m^3$/adt pulp to a level of 10 $m^3$/adt an increase in chemical consumption is seen, which thus leads to an ever increasing amount of organic chlorine compounds from bleaching. Thus, a conclusion may be drawn that the closing of the water cycles of bleaching as such does not have a direct influence in the amount of organic chlorine compounds, but on the other hand a smaller amount and a greater concentration of effluents allow for easier and more economical purification thereof.

Chloride-containing chemicals are used in bleaching so that the total chloride dose into the chemical cycle is 5-10 kg of chlorides per one ton of chemical pulp. Because this amount has to be made to pass so that the amount of liquid to be evaporated in the process remains reasonable, the challenge is to find such a process arrangement, where a chloride-containing liquid replaces some other liquid used in a process at the mill. Thus there is no need for separate treatment stages, new non-productive sub-processes at the mill, but the treatment can be carried out by means of existing process stages.

In order to be able to optimize the treatment of a chloride-containing liquid and in practice the treatment of bleaching effluent, it is inevitable to first know the properties of the effluent. In the bleaching, chlorine-containing inorganic compounds and organic chlorine compounds from the reactions of chlorine dioxide or chlorine remain in the process. Bleaching separates from the fibers various compounds of lignin, which remain in the effluent in form of organic molecules. Additionally, sulfuric acid is used in bleaching for pH regulation and as main chemical in the hydrolysis of hexenuronic acids. Sodium hydroxide is also used for pH regulation and lignin extraction in alkaline stages. In addition to these, depending on the bleaching sequence, oxygen and peroxide are used in bleaching, which, however, are in elementary analysis such substances that their contribution in for example purification processes is not noticed. In some special cases, also hydrochloric acid may be used in pH regulation and sulfur dioxide or other reductants in elimination of chemical residuals from the bleaching, i.e. in elimination of unreacted bleaching chemicals.

Closing of the bleaching is based on recycle of filtrates of washing apparatuses from later bleaching stages to preceding stages. The bleaching is planned only for circulating filtrates between bleaching stages and pulp from one stage to another to react with different bleaching chemicals. Thus, closing the whole bleaching is as an idea based on the fact that all substances separated in bleaching end up in filtrates. Optimizing the closing of bleaching is in a great part based on the way how reaction products of bleaching disturb the process of bleaching. Although in many various connections it has been stated that different degrees of closing are possible, practical experience has shown that such washing water arrangements of bleaching where the filtrates are connected so that the amount of effluent is less than 12-13 $m^3$/adt increase the consumption of bleaching chemicals. Naturally, the quality of the pulp and the construction of the bleaching plant dictate the amount of additional chemicals used in the bleaching as the effluent amount of the plant decreases below the above presented level.

Often a research dealing with the closing of bleaching ends in a conclusion that the closing of bleaching succeeds, but the bleaching should be provided with a sink or a kidney in which harmful inorganic substances could be separated from the process. This kind of kidney is often described as a process operating with either membrane technique or ultrafiltration, which again would be a kind of new and separate by-process at the mill. In addition to that, the processes are fairly new and their continuous technical performance has been questioned. As the above-stated is combined with remarkable operational costs, the technology development has not become general.

Thus, partial closing of bleaching and external purification of the generating filtrates (with a volume of 10-15 $m^3$/adt) using e.g. filtration, various known forms of biological treatment, different techniques of chemical treatment and clarification has been regarded as the so-called best available technology for bleaching effluents. After this, the treated water is led back to the water course to the same channel wherefrom the liquid was taken to the mill process or to a different channel. This is in use at both TCF- and ECF-pulp mills. Biological treatment is efficient specifically when the proportion of detrimental organic substances is decreased, which mainly comprise lignin compounds separated in bleaching, hemicelluloses and components originating from extractives, which constitute a significant portion of effluent coming from the bleaching plant. There is an ample amount of various wood-originating compounds, and part of the compounds are chlorinated and part of them are low-molecular compounds of carbon and hydrogen. As microbes act so that they use as nutrition only the organic portion of effluent, all in-organic substances, at least inorganic elements remain in the effluent. Thus, biologically treated effluent has an organic load that makes it clearly cleaner than effluent treated in other ways, but due to the in-organic substances the only choice has been to discharge it from the process.

SUMMARY OF THE INVENTION

The present invention, in an embodiment, eliminates above-mentioned problems and provides a pulp production process with minimized effluents. An object of an embodiment of the present invention is to offer a method for utilizing liquid flows generated at a chemical pulp mill in an advantageous objet and for efficiently circulating them without disturbing the main process and minimizing the emissions from the mill.

A public research was carried out at the University of Oulu, Finland, on the washing process of pulp bleaching and the operational efficiency of process stages between the washing processes compared to the efficiency of a preceding washing stage (Viirimaa, M., Dahl, O., Niinimäki, J., Ala-Kaila, K. and Perämäki, P. Identification of the wash loss compounds affecting the ECF bleaching of softwood kraft pulp. Appita Journal 55 (2002)6, 484-488). The decrease in the bleaching stage efficiency is observed either as decreased brightness development or as a higher kappa number after a bleaching stage or bleaching stages. According to an essential result of the research, the most important individual component in the filtrate hindering the bleaching is lignin. Based on said research, two conclusions can be drawn: The amount of inorganic substances in a bleaching stage is not essential in view of the bleaching result and by specifically removing the lignin or remarkably decreasing the amount of lignin the bleaching result could be clearly improved and finally reach a bleaching result which is at the same level as in a bleaching plant, the filtrate cycles of which are not closed. This result renders a possibility of significantly optimizing the bleaching process. As the effect of inorganic compounds on chemical consumption is basically not significantly essential, for pulp washing can be accepted a washing water having significant amounts of inorganic compounds. These issues are utilized in the process according to an embodiment or the invention.

The present invention, in an embodiment, relates to a method in connection with the washing of pulp at a pulp mill comprising at least an alkaline cooking process utilizing cooking liquor for producing pulp, brown stock treatment with essentially closed liquid cycles, wherein the last washing device is a washing device based on pressing of the pulp, a press or a washing press, a pulp bleaching plant using ECF-bleaching, in which chloride-containing effluents are formed, a chemical recovery plant comprising at least a black liquor evaporation plant, and an effluent purification plant for treating effluents formed at the mill. A feature of an embodiment of the invention is that purified effluent in an amount of at least 1 $m^3$/adt pulp is introduced into the dilution after the press or washing press, which effluent is passed entrained in the pulp from the dilution into the first process stage of the bleaching.

According to a preferred embodiment of the invention, the first process stage of bleaching is acid treatment, a D-stage, an ozone stage, an alkaline extraction stage (such as EO, EP, EOP) or a peracetic acid stage.

The washing liquid for brown stock is typically fresh water, evaporator plant condensate, and/or dryer machine circulation water.

An alkaline cooking process, such as a kraft process or a sulfate process or a soda process, is based on batch cooking or continuous cooking comprising a digester or several digesters. Brown stock treatment comprises a washing process, and typically oxygen delignification, typically a screening process and washing after oxygen delignification, which washing can comprise one or several washing devices. The screening may be located after digester blowing, in the middle of or after the washing process or after oxygen delignification. These process stages are followed by a bleaching process based on ECF-technique, which comprises a pulp bleaching plant with one or more bleaching stages based on the use of chlorine dioxide in addition to stages using other known bleaching chemicals. The connection of the mill also comprises a chemical recovery plant comprising a black liquor evaporation process typically with an in series connected evaporation plant, a chemical recovery boiler, and a chemical production plant for producing cooking chemicals.

In connection with an embodiment of the present invention, the last washing device of the brown stock treatment zone in the flow direction of the pulp is a press or a washing press. The operation of the presses is typically based either on simple dilution mixing and pressing or a combination of dilution, thickening, displacement and pressing. Typically a press comprises at least one wire-coated or drilled perforated plate coated drum. Pulp is typically fed in at a consistency of 1-12%, e.g. at a consistency of 3-8%. The drum shell is typically provided with compartments, wherefrom the filtrate is led out via a chamber at the outer periphery. The drum may also be open, such that the filtrate is collected inside the drum and directed out via an opening at the end of the drum. In one press solution, the pulp is fed into a space between a perforated drum and a vat partly surrounding the drum, which space decreases in the rotational direction of the drum. Thus, a pulp web is formed on the surface of the drum or drums, whereafter washing liquid is fed into the pulp. Pulp is led into a narrow slot i.e. nip between the drums or the drum and a roll by means of a rotating movement of the drums or drum and the roll, and thus removal of water is effected via the holes in the drum. This filtrate is collected into a filtrate container, wherefrom it is led further elsewhere. In one washing press solution, the pulp suspension is introduced into a nip between two drums in order to form a pulp web onto the surfaces of the drums. After the nip, the pulp is washed and the pulp web thickened by pressing it e.g. in a narrowing gap between the drum and a washing flap partly surrounding the drum. The washed pulp may have a consistency up to 25-40%. However, displacement is typically carried out at a consistency of 10-15%. Washing presses have been presented e.g. in publications EP 1098032 and WO 02/059418, which are mentioned as examples only.

According to a preferred embodiment of the invention the purified effluent being returned is heated by means of heat obtained from the effluent being led to purification and heated effluent is used at the pulp mill. Preferably the connection comprises a heat exchanger system, in which the effluent being returned from purification is heated by means of heat obtained from the effluent being led to purification. Heated, purified effluent is used e.g. in a last washing stage included in brown stock treatment.

In accordance with an embodiment of the invention, at least 20% of the purified effluent is recycled to the chemical pulp mill, preferably at least 40%, most preferably at least 60%.

DETAILED DESCRIPTION

Because the technique presented herein is based on solutions affecting the arrangements of the mill and the balance of the mill, it is not possible here to define in great detail all the processes which are influenced by the new arrangement. Nevertheless, e.g. literature describes known processes of the whole mill, and the apparatuses and pulping methods included in this patent application are essentially known per se. Further, the application of an embodiment of the present invention is based on apparatuses known per se. Thus, developing new technical innovations sometime in the future is not necessary for implementing an embodiment of the present invention. The present invention, in an embodiment, can be implemented at a chemical pulp mill having a digestion process, bleaching, other treatment of pulp, chemical recovery and chemical production comprising various reactors, vessels, pumps, mixers, filters known per se or a corresponding device for washing pulp.

When the effluent coming from the bleaching plant has been purified in a biological effluent treatment plant representing the newest technologies, the chemical oxygen demand, COD, thereof has decreased by more than 70% and the organic chlorine compounds content by AOX-measuring has decreased by more than 50%. If an anaerobic treatment stage is added to the system, so also the color of the water being treated has decreased remarkably. Thus, this biologically treated water is clearly cleaner than conventionally recycled filtrates in the $D_0$-stage and the first alkaline stage of the bleaching plant. The effluent can also be subjected to chemical purification methods that are based on precipitation or oxidation of oxidizable compounds. The availability of this treated effluent in accordance with an embodiment of the present invention, whereby it is passed in an remarkable amount entrained in the pulp to the first stage of bleaching, is much better in view of the organic matter than the use of filtrates from said bleaching stages, for instance from the $D_0$-stage, in bleaching or even in brown stock washing. For instance the technology definement of the European Union dealing with the technology of the forest industry, Bat, i.e. Best Available Technology, defines the object of application of the filtrate from the first alkaline stage to be the washing following the oxygen stage. On the other hand, chemical pulp producers utilizing pressing technology have already during many years diluted pulp only with a filtrate from the $D_0$ stage prior to the $D_0$-stage. Due to this connection, chemical consumption of the bleaching as a whole has increased, but nevertheless it has remained at a level that has in many cases been acceptable.

When the last apparatus before bleaching is a press or a washing press, then the water consumption thereof is divided such that the washing uses in the amount of 3-6 $m^3$/adt liquid and the pulp is discharged from the apparatus at a consistency of higher than 20%, typically at 25-35%. Because after this the situation is such that the pulp is to be diluted prior to bleaching to a pumping consistency of 8-16%, for which purpose the consumption of dilution liquid is 3-6 $m^3$/adt. Now, if both liquids are purified effluent from the purification plant, chlorides are passed into the chemical cycle. When only the dilution liquid is replaced with purified effluent from the purification plant, lignin removal provides remarkable advantages in chemical consumption compared to unpurified filtrates from the bleaching, but then the chemical cycle remains unchanged and chlorides are not passed to the recovery boiler. This can be a recommendable connection when the recovery boiler is not provided with devices by means of which chloride levels can be controlled.

The use of a press in this connection enables various connections so that the use of effluent and the passing of chlorides to recovery can be optimized. In this way, alternative connection models can be formed, of which it is possible to choose the most suitable alternative or combination of alternatives in view of the balance of each individual mill.

1. The basic solution is mentioned above, in which purified effluent is introduced into the press washing device for both washing and dilution. Then the precondition is that the chemical recovery plant is provided with a system suitable for chloride level control and the systemic advantage of the effluent gives the best possible final result in view of savings in water.

2. A solution, in which some presently known washing liquid, such as e.g. hot water, evaporation plant condensate, warm water or drying machine circulation water is introduced to the press washing device. Then, purified effluent is introduced only to dilution located after the washing press device. In case of the bleaching of medium consistency (MC) pulp, the consumption of purified effluent is maximum 6 $m^3$/adt pulp. In this case, no chlorides are passed to chemical recovery and the specification of the recovery can remain unchanged. In this case the use of purified effluent is first and foremost connected to improving the bleaching result, because the comparison is made to a situation where some bleaching filtrate would be used in the same process location. Purified effluent is cleaner as to its properties, and thus it does not cause e.g. brightness losses, extra chemical consumption, not to mention brightness ceiling.

3. If the washing device preceding the bleaching is not a washing press, but only pressing is carried out in the device, introduction of washing liquid into the washing balance does not take place in the washing device itself, but in dilutions preceding the press. Then any dilution object between in series connected washing devices is a possible washing liquid addition point. Further, the washing liquid can be taken partially or even totally to a washing device preceding the last press and the last washing device operates so that its own filtrate acts as dilution liquid. There are several technical solutions, but in view of the overall system it is not essential, how the purified effluent is physically introduced into the chemical cycle. A corresponding situation can take place also in relation to washing presses. If a sufficient amount of washing liquid can not be introduced into a washing press due to capacity reasons or other reasons, a portion of the liquid is to be introduced into the system via dilution liquids.

4. There are also connections, in which the washing device preceding the bleaching is open, i.e. the water cycle thereof is not connected countercurrently and accordingly the introduction of purified effluent as a whole has to be effected such that it is carried out at a washing device preceding the open washer.

5. The bleaching alternatives can operate at the low consistency range (LC) of pulp, 3-6%. In that case the amount of dilution liquid introduced to dilution following the press washing device can be even 30 $m^3$/adt.

When treated effluent is used in dilution following brown stock washing, part of the compounds of the effluent is passed entrained in the pulp to bleaching, especially to the first bleaching stage. As can be noted from these short definitions, the properties of treated effluent are especially preferable in bleaching, specifically in view of the organic substances. However, inorganic substances and especially various forms of chlorine molecule in organic and inorganic forms have prevented the utilization of this effluent at the bleaching plant and specifically in brown stock washing. However, ECF-bleaching always generates chloride compounds, because chlorine dioxide as such is a compound that contains chlorine molecules.

Due to the chemical properties of the pulp, the bleaching technology is in a situation where the bleaching effluents are 7-17 $m^3$/adt of effluent so that the AOX emission from the bleaching line is 0.15-0.5 kg/adt and COD 20-40 kg/adt and after purification the AOX is 0.06-0.3 kg/adt and COD 4-15 kg/adt. Thus, it can be stated that if a lower emission level is desired in an economically sustainable way, it will not happen by conventional development of processes aiming at closing. There is a need to determine a technology wherein the whole system is understood in a new way, for instance as described in the present invention.

U.S. patent application Ser. No. 12/107,877 and corresponding patent application PCT/FI2008/000053 describe possible techniques for treating bleaching effluents so that they are finally passed into the recovery boiler for combustion and separation. An essential feature of this application is that the treatment of chloride-containing liquids in the recovery boiler process does not lead to stronger corrosion and that the recovery boiler process is excellent for separating chloride-containing compounds from the process in order to prevent the accumulation of chlorine. There the chlorine content of flue gases is maximized by increasing the temperature of the combustion zone, where the chloride-containing liquor is combusted. Preferable combustion conditions are determined for the recovery boiler, under which chlorides will start to volatilize into flue gases, and a process location, where the chloride can be removed from the process. Thus, the recovery boiler can be made a chloride sink of the mill and the whole problem caused by chloride is eliminated there, where it was previously supposed to be most harmful. If the chloride-content would grow excessively high in this solution in view of the desired temperature of steam or temperatures of steams, the final superheating or final superheatings of the steam can be carried out in a way describe in US patent applications 2005/0252458 and 2006/0236696, utilizing in a front chamber fuels that do not cause corrosion.

However, the arrangement presented herein, where purified effluent is used in dilution after brown stock washing before bleaching, allows circulating purified effluent into the bleaching process such that a separate chlorine-separation process in the recovery boiler process is typically not required.

A specific feature of an embodiment of the present invention is to create a process that is clearly more closed than prior pulp mill processes. Some goals achieved by embodiments of the present invention are:

1. Decreasing the environmental load of the chemical pulp mill
2. Keeping the use of the pulp mill's chemicals and commodities at least at the present level
3. Maintaining the pulp quality at the chemical pulp mill at essentially the same level as in the existing processes
4. Decreasing the amount of water used by the chemical pulp mill.

Of these goals points 1 and 4 could be accomplished with the same techniques, but in that case goals 2 and 3 will be very laborious and difficult to reach with the same methods. Therefore, the technique presented herein makes all the four goals reachable simultaneously.

ECF-bleaching comprises both acid and alkaline stages. In a typical ECF-bleaching arrangement, a filtrate is discharged as effluent from the first D-stage and from the first alkaline stage. Closing of the bleaching has been studied from many starting points in several publications and the general conclusion has been a level, wherein the connection of the bleaching has been arranged so that a modern ECF-pulp mill produces bleaching effluent in the amount of 6-20 $m^3$/adt, most typically 7-16 $m^3$/adt. When the amount of generated effluent is less than 10 $m^3$/adt, it has been shown that due to the low effluent amount also the use of bleaching chemicals at the mill starts to grow. Thus, it is essential that the bleaching plant receives an adequate amount of such clean or purified water fractions, which do not increase the bleaching chemical consumption.

A bleaching sequence, several of which are determined by the relevant literature in the field starting from either two-stage sequences up to historical seven-stage sequences so that after a first acid combination stage or first acid combination stages follows an alkaline stage and after that at present an acid plus acid stage or an acid plus alkaline stage. Acid stages comprise chlorine dioxide stages, ozone stages, a hexenuronic acid removal stage or some stage based on acid peroxide treatment. An alkaline stage is typically a treatment, wherein the pH is increased to exceed 7 by means of some hydroxide compound, most typically sodium hydroxide, and wherein hydrogen peroxide, oxygen, hypochlorite or some other oxidizing chemical is used as additional chemical. In this kind of arrangement, circulation water originating from a pulp drying process after the bleaching plant is introduced to the last washing apparatus located after all bleaching stages, but it can also be used in earlier stages. As this water originates from the water removal process of the drying machine, it belongs to the internal cycle of the chemical pulp mill and thus does not increase the amount of consumed water.

Brown stock treatment after the cooking process includes a washing process, and typically an oxygen stage, screening and an oxygen stage followed by washing. It is known that this process complex is arranged such that the last washing apparatus in the oxygen stage receives the purest washing liquid for facilitating the bleaching of the pulp, and the filtrate obtained from this last washing apparatus is used in accordance with counter-current washing principles as washing liquid and in dilutions. When the filtrate is recovered from the first brown stock washing apparatus, it is forwarded either directly to a black liquor evaporation plant or it is used in digester plant processes for dilution and displacement, after which it ends up in the black liquor flow.

In the novel solution, the water consumption of the mill has been modernized. Per one ton of air-dry pulp, a conventional arrangement had to use:

3-5 $m^3$ of condensate or hot water in white liquor production.

4-10 $m^3$ of condensate or hot water in brown stock washing. Hot water from the digester plant.

1-3 $m^3$ of liquid originating from the bleaching chemicals, mainly from chlorine dioxide.

1-5 $m^3$ of hot water for bleaching washes for washing either the drum or rolls and e.g. to EOP-washer as washing water.

2-4 $m^3$ of fresh water to the drying machine for washing of felts.

1-3 $m^3$ of cleaned or raw water to be used as sealing water and for coolings. Of this water approximately 60-80% can be circulated inside the mill.

Additionally the digester plant uses 0-6 $m^3$ of fresh water for cooling, and this water is the main source of hot water. Because the digester plant has conventionally been considered as the main source of hot water, the aim has been to produce hot water a certain amount, for instance 2-5 $m^3$.

As a result of this kind of water consumption, the flows exiting the mill can be determined:

8-11 $m^3$ together with black liquor to evaporation. Thus the condensate forms an internal cycle.

The solid matter of black liquor is formed of many kinds of compounds which originate from organic, mainly lignin and carbohydrate based compounds.

Condensates are formed from various stages of the evaporation plant in the amount of 7-10 $m^3$.

8-10 $m^3$ of effluent from the bleaching to the purification plant containing the chemicals of bleaching, 1-5 $m^3$ of effluent from the drying plant from felt washing and sealing waters as well as coolings.

The sealing and cooling water flows generate 1-3 $m^3$, but these fractions can under certain preconditions be circulated with rain waters to channels. Thus, the total amount of generated effluents is 15-25 $m^3$ per a pulp ton and added thereto the effluent from wood handling. Further, also in wood handling either a filtrate from bleaching or purified filtrate from bleaching can be used without process problems, but as the conventional devices in wood handling are made of carbon steel, the use of a chloride-containing liquid would require revision of the material specifications.

When purified effluent is used in pulp production, the water consumption per air dry pulp ton is mainly divided as follows:

3-5 $m^3$ of condensate to be used as washing water in brown stock treatment.

3-5 $m^3$ of filtrate from bleaching and/or purified effluent and/or hot water in white liquor production.

2-5 $m^3$ of purified effluent from the water treatment plant in brown stock treatment into the dilutions of the last pressing device.

1-3 $m^3$ of liquid originating from bleaching chemicals, mainly from chlorine dioxide.

Now this can be replaced with e.g. condensate from the evaporation plant or filtrate from the effluent treatment plant.

1-5 $m^3$ of evaporation plant condensate for washing processes of bleaching. It is used either for washing the drum or rolls and for the washers of the bleaching as pulp washing liquid.

2-4 $m^3$ of condensate water to the drying machine for washing of felts.

1-3 $m^3$ of condensate from the evaporation plant or raw water to be used as sealing water and for coolings. Of this water approximately 60-80% can be circulated inside the mill.

Additionally the digester plant uses 0-6 $m^3$ of fresh water for cooling, and this water is the main source of hot water. Because the digester plant has conventionally been considered as the main source of hot water, the aim has been to produce hot water a certain amount, for instance 2-5 $m^3$. However, in the novel arrangement the digester plant can heat effluent from the effluent treatment plant or the hot water is to be cooled without utilizing the heat.

As a result of this kind of water consumption, the flows exiting the mill can be determined:

9-11 $m^3$ together with black liquor to evaporation. Thus the condensate forms an internal cycle.

Condensates are formed from various stages of the evaporation plant in the amount of 6-9 $m^3$. These condensates are used at various locations in the process, as presented in the above.

10-15 $m^3$ of effluent from the bleaching to the effluent treatment plant.

2-5 $m^3$ of effluent from the drying plant from felt washing and sealing waters as well as coolings.

The sealing and cooling water flows generate 1-3 $m^3$, but these fractions can under certain conditions be circulated with rain waters to channels.

Thus, the total amount of generated effluents is 0-10 $m^3$ per a ton of pulp, more preferably 0-7 $m^3$, most preferably 0-4 $m^3$. Added thereto is the effluent from wood handling. A remarkable portion of these flows consists of sealing waters, collection waters from the channel or other sources that are secondary in view of the process.

So it can be seen that a real technological improvement is obtainable, where the goal can be set as high as to a level of 0 $m^3$/adt effluent from the process in a steady running situation.

The described technique is preferably in connection with ECF-bleaching, but there are no technical barriers for applying various embodiments of effluent utilization in TCF-bleaching, i.e. a bleaching process carried out totally without chlorine or chlorine chemicals.

As pulp washing and white liquor production typically require approximately 10-16 $m^3$ of liquid/adt pulp, it can be seen that treating and producing such an effluent amount for these needs is advantageous. The environmental requirements that are most essential in view of the whole mill are related to bleaching effluent that is both a significant source of biological and chemical oxygen consumption, and above all, the organic chlorine compounds generated in ECF-bleaching cause concern. Other effluent flows of a pulp mill comprises cooling waters, sealing waters, reject flows, channel water, washing water of the plant and rain waters, as well as wood handling water. With the exception of wood handling water, said waters have not been in contact with a process containing chlorine compounds. The emissions accumulated therein are mainly leakages and overflows, occasional emissions caused by apparatus breakage, washing waters of devices, textiles or containers originating from continuous or batch washings, and leakages from the reject system. The harmful effect of this kind of mill effluent fractions to the environment is mainly based on oxygen-consuming compounds. It can thus be stated that only bleaching effluent contains e.g. chlorinated organic compounds, which commonly are regarded as the most detrimental in view of the environment.

The advantages of the present invention are best highlighted such that at an effluent treatment plant various effluent flows are treated in different sections. Thus, bleaching effluent would be treated in separate basins, isolated from e.g. debarking plant effluents. On the other hand, in that case the effluent will not be diluted as a result of cooling waters or rain waters. Further, if the plant has several separate bleaching lines and possibly several chemical recovery lines, even in that case the flows with the highest chlorine chemical content can be led to a treatment unit, whereform the purified effluent is returned to mill processes, such as in the first place to brown stock washing treatment. That way, the organic chlorine compounds could be concentrated in the flow being returned to the mill, and less detrimental flows would be purified and led into a river.

An advantage of separate treatment lines is also the control of non-process elements (NPE). As e.g. the water from the wood yard contains plenty of substances originating from bark and the surface of the wood, as well as sand and dust adhered thereto during harvesting and transportation, these impurities can end up as detrimental substances in the chemical cycle of the pulp, if this kind of effluent was introduced thereto. When one effluent treatment line treats bleaching effluents only, the effluent returned therefrom contains as impurities only substances that are released in bleaching, chemicals required in the purification process and chemical used in pH regulation.

Via separate treatment it is also possible to control especially the passing of organic chlorine compounds in the bleaching and out of the bleaching via purification into the water way. As many other flows exiting the mill, such as sealing waters or rain waters, are still very clean even when they end up in the effluent collection system, it is unnecessary to mix these flows with e.g. effluent from bleaching or the debarking plant. Thus, e.g. the sealing waters can be recovered and reused, the cooling waters can be circulated in mill processes etc. Only when these waters are contaminated due to e.g. apparatus breakages etc., they are to be collected and led to purification. As it is now advantageous that the amount of effluent from bleaching and water being reused in the process is in equilibrium, this aim also presumes both an ever more efficient circulation of clean water fractions and treatment of various effluent fractions in separate purification lines.

An example of this are the rain waters. The mill area may receive rain during several days and the water amount in the runoff area can due to the rain be several cubic meters in an hour. Although the water is mainly clean, it can still unnecessarily dilute the water being passed to purification. Additionally, the rain can flush e.g. sawdust and fibers from the mill area, or from the mill black liquor that has flown onto the floor during a disturbance situation. Thus, the rain water can also cause surprising load peaks for the purification process. Because the mill process is capable of receiving only a certain amount of purified effluent back into the process, load variation caused e.g. by rain would significantly affect the amount and quality of effluents exiting the mill. If bleaching effluent is treated separately, then the bleaching effluent volume is mainly influenced by only the rain water exiting the bleaching plant and rain water passing into clarifiers, aeration basins and other open constructions. Thus, the runoff area can be minimized and also the volume and load variation are small.

Because one alternative is to use oxidized white liquor or white liquor in the effluent plant neutralization, also then it is advantageous to purify the bleaching effluents in a dedicated treatment line or basin. When the treated effluent has been neutralized and is returned to the process, at the same time it is ensured that compounds capable of disturbing the process are not allowed to enter the chemical cycle via neutralization agents. Thus, unslaked lime (CaO) used at most plants would be clearly more troublesome in view of the process and would cause clearly more trouble than white liquor compounds. As already mentioned, when a separate purification line is used specifically for bleaching effluents, the components of white liquor are obtained back to the chemical cycle and the passing of non-process elements to the process is minimized.

The amount of effluent is now dependent on the efficiency of utilization of condensate in the mill processes. Additionally, the digester plant always produces a certain amount of hot water, which is either circulated to the process or, if the process does not have opportunities to utilize the water, the water is to be cooled.

Further, also in wood handling either a filtrate from bleaching or purified filtrate from bleaching can be used without process problems, but as the conventional devices in wood handling are made of carbon steel, the use of a chloride-containing liquid would require revision of the material specifications. In a normal mill process the effluents from wood handling are introduced into a common purification process, wherefrom they are returned in form of clean water to the processes of the mill.

In addition to said main streams, there are so-called secondary streams in a chemical pulp mill depending on the locations of the mill, the chosen processes and required final cleanliness levels, which streams have to be subjected to separate treatment stages when closing the mill process. This kind of streams include vent vapors containing mainly water, such a dissolver vent vapor, vent vapor from the gas scrubber of bleaching, vapor originating from flue gases, vent vapor from pulp drying or in case of an integrate even vent vapor from the paper machine drying sector, vent vapor of continuous outblow, ventings of white liquor oxidation, gassings originating from the digester plant, gaseous emissions and water vapor from the oxygen stage, water vapor concentrated from HCLV and LCHV gases and other corresponding secondary streams. Also, the combustion of hydrogen-containing substances produces water, which in the total balance of the mill converts to one liquid stream of the mill. All these have their own specific chemical features, and if the aim is a more and more closed pulp mill, e.g. microfiltration, membrane technology, ion change technique, developed evaporation techniques and other developed purification techniques may be needed in addition to the present so-called conventional purification methods. Also these streams can be utilized, either directly or after applicable treatment stages, as process waters of the pulp mill. Thus, these secondary streams are comparable to the condensates of the evaporation plant or to purified bleaching effluent.

The streams presented herein are only examples of some possible solutions. Because there are hundreds of chemical pulp mills having processes with various connections and technologies, it is impossible to define such water usage areas that would apply for all mills. Thus, the areas and amounts presented herein are directive and set frames to the use of water at modern chemical pulp mills, and describe the possibilities that the technique presented herein will improve.

The waste liquor generated in the herein presented exemplary sulfate pulp cooking process is delivered to the evaporation plant, wherein the dry matter content thereof is increased in an in-series connected evaporation process from a level of 10-20% most commonly to a level of over 75%. Condensates originate from the evaporation plant, which condensates mainly equal to distilled water and comprise several organic small molecule substances, which are known from literature on evaporation and the best known of which is methanol, as well as inorganic compounds of sodium and sulfur. Because condensates from the evaporation plant have already during several years been used in the brown stock washing process to economize on fresh water, purification methods for purifying condensates have been developed inside the evaporator itself, such as condensate segregation systems and external purification methods, for instance condensate stripping. Actually it is the object of application of the condensate that dictates the amount worth investing by the mill in the cleaning of condensates. Additionally, an object of study has been the oxidation of organic substances in the condensates with e.g. ozone. The condensates will be very clean and applicable in several objects in the bleaching plant and the fiber line. Now in the novel arrangement it will be inevitable to use condensate in the fiber line and other departments to new objects, because real economy and advantage in view of chemicals and pulp quality are not reached simultaneously if condensate is not utilized to full extent.

In the system presented herein condensate is used not only and mainly in brown stock washing, but the objects of application of condensate are emphasized in pulp bleaching and drying machine process. Thus, the novel arrangement will require adequate cleaning of condensates, so that these can be used in new object, which finally provide the advantage obtainable from the novel arrangement.

Clean water is needed in the pulp drying plant for cleaning felts and dryer machine textiles. When the condensate is cleaned to an adequate extent, e.g. to a very low content of COD and malodorous compounds, it can be used also in dryer machine processes, such as cleaning water for felts. Further, the condensate is applicable to high-pressure washing of wires used in web formation in a drying process, but typically a precondition for this is that a significant amount of malodorous compounds has been removed from the condensate. As the objects of application of condensate this way increase remarkably, new cleaning methods in addition to conventional condensate cleaning may be needed, such as e.g. ozonization for decreasing the amount of malodorous compounds in the condensate.

Because in the novel arrangement purified effluent can be delivered to various objects of application in the process, different fractions of the effluent may be exposed to various types of quality requirements. Thus, the effluent treatment process can be carried out so that e.g. fractions containing more lignin are divided into one purification line and fractions containing less lignin but more color compounds are purified in another line. Also various effluent fractions such as foul filtrate of an acid filtrate, clean fraction of an acid filtrate and alkaline filtrate can be purified in a process following the bleaching as separate fractions so that their properties in the object of reuse will be optimal.

Effluent purification processes typically comprise pretreatment, neutralization, biological treatment by an aerobic or anaerobic method and possible chemical treatment. It is possible that effluent treatment is solved using a so-called aerated lagoon, whereby the purification efficiency is lower than that of a biological effluent treatment process. Finally, clarification is performed, where sludge generated from bacterial activity is removed. This sludge can be delivered further into the recovery boiler for combustion together with black liquor, which is already the practice at many mills. Chemical methods allow precipitating of detrimental substances from the effluent so that the quality of the effluent is improved. Additionally, effluent can be oxidized with e.g. ozone or oxygen. With these methods, a solution for a purification plant can be found, by means of which the effluent is made adequately clean for the presented objects of application.

Various methods have also been studied which are based on microfiltration and membrane technique and osmosis, of which not many industrial applications have been reported yet. However, their use is not excluded from the scope of the present invention.

There are several effluent treatment plant producers around the world who have their own connections for purification processes. Thus, the processes can not be determined universally, but they are characterized by the above-mentioned issues. Additionally, retentions etc. properties vary, so that the invention is not limited to a single known purification plant specification.

In all purification methods it has been stated that chloride-containing inorganic substances are passed out of the mill entrained in liquid, but remarkable amounts of the organic substances are either converted or decomposed as a result of purification. As the aim is to remove significant amounts of compounds that are detrimental to bleaching, it can be stated that especially biological effluent treatment reaches this goal very well. Because biological effluent treatment removes significant amounts of lignin, the water thus treated is most suitable for the purpose of being used in a brown stock washing process.

For effluent treatment, the effluent has to be cooled first so that the bacteria can act properly. Because the treated water is returned to the process most preferably at process temperature, the system is arranged by means of usual heat exchangers so that one part of an effluent cooler is reserved for the effluent to be cooled and treated effluent acts as a cooling liquid. In such a case the untreated effluent reaches the temperature that is required for effluent treatment, typically below 40° C., and the recycled liquid is heated to a temperature of 65-80° C. so that when the liquid returns to the fiber line, the heating thereof consumes reasonable amounts of steam. When an adequate number of heat exchangers is added to the system, in a most preferable situation e.g. cooling towers can be omitted, which have been used in great numbers for effluent cooling at chemical pulp mills.

Another possibility for heating the treated effluent are the digester plant cycles. The digester plant requires for the coolings a liquid at a temperature of approximately 20-60° C. and warm water or some unheated water fraction of the mill is commonly used for that purpose. If a proper material is selected for the heat exchanger, the cooling can be carried out by means of treated effluent. It is true that treated effluent contains chlorides, but because the pH is neutral or can be adjusted to be even slightly alkaline, the material does not cause an unreasonable cost.

The recycled treated effluent can, due to the presence of bacteria, be assumed to contain remarkable micro-organism activity, which may cause dirt or odor problems. Nevertheless, if the conditions of ECF-bleaching are analyzed in more detail, it can be stated that chlorine dioxide is a strong oxidant and bacterial activity is insignificant in the conditions of chlorine dioxide bleaching. Further, temperatures over 80° C. and change of pH between the bleaching stages from acid to alkaline so that also peroxide is typically present in the stage result in a situation that all remarkable organism activity is almost impossible when the treated effluent reaches the bleaching stage.

Effluent can be introduced to one purification plant from several sources. If there is other wood handling industry in the same industrial area or nearby, typically paper machines, mechanical pulp mills or sawmills, these effluents can still be treated in one and the same purification plant. Additionally, the purification plant can treat municipal waste waters from nearby cities and in some cases also waters from other production plants. In case the purification plant also treats other effluents in addition to the chemical pulp mill effluents, the quality of elements originating elsewhere than from the pulp mill is to be studied before water from this kind of purification plant is used at the chemical pulp mill. It may e.g. be difficult to use calcium-containing purified effluent in the fiber line due to precipitates, but the use thereof may well be possible in causticizing.

Now the treated effluent with a certain residual chemical oxygen consumption level and a level of organic halogens (AOX) is passed into the chemical cycle where it is in practice concentrated in evaporation to the form where it is combusted in the recovery boiler. If 90% of the effluent is returned to the chemical cycle after purification, the amount of AOX-level being passed to the water system is also reduced by approximately 90%. Thus, if the AOX amount being passed to the water system after purification would be 0.2 kg/adt, so with the novel arrangement, in which 90% of the purified effluent is recycled to the mill, a level of 0.02 kg/adt is reached. The same reduction can be noted also with chemical oxygen demand. Due to these reasons, the use of purified effluent is a real step towards a closed chemical pulp mill process and allows for an almost pollutant-free process. Nevertheless, it has to be accepted that there are some exceptional situations when effluent can not be recycled from the purification but it has to be temporarily delivered to the water way.

Bleaching effluent with the dissolved lignins is purified in an external treatment with either mechanical, chemical, biological or oxidizing methods or by means of some combination of methods, where the COD of the effluent is decreased without dilution by at least 30%, preferably more than 40%, most preferably more than 60%, and/or the lignin-content of the effluent is decreased without dilution by at least 30%, preferably more than 40%, most preferably more than 60%.

Purified effluent is determined such that it is used undiluted in washing or dilutions. However, due to different arrangements of the mills and in cases when e.g. bleaching does not produce an adequate amount of effluent for the above-presented objects of application, a solution can then be a controlled dilution of untreated effluent. Additionally, there are situations, when, due to chemical equilibrium, dilution of the effluent is desired in such a way that the chemical equilibrium remains in control. However, in view of an embodiment of the invention it is essential that at least 20% of the liquid required in each object of application is purified effluent independent on the object, where the purified effluent is used. Further, in view of an embodiment of the invention it is essential that dilution takes place in a controlled way in the process.

Naturally, dilution can be carried out anywhere within the mill processes so that the requirement of controlled arrangement of the dilution is met.

Although the main principle is that a bleaching process typically does not require other effluent treatment in addition to a biological process, in some cases the use of purified effluent e.g. for food product packings or hygiene products may, however, cause a risk of bacterial action or other disturbances causing e.g. odor. In that case it may become necessary to purify the water for example chemically in order to minimize the detrimental compounds.

A resulting effect of this is that it is worth while to use in the fiber line condensate coming from the evaporation plant in significant amounts, i.e. 1-5 $m^3$/adt, in order to maintain adequate cleanliness of the pulp and to obtain an adequate amount of liquid into the mill's liquid cycle for preventing accumulation of inorganic substances. In the novel arrangement there is a real need for this due to the new objects of application. Thus, new objects of use of the mill condensates will be clean water flows of the drying machine, for instance such that the washing of felts and wires will in the future be carried out using condensates from the evaporation plant. In that case the condensates are to be purified so that detrimental or malodorous compounds are not released via the dryer machine or dryer room into the atmosphere.

If the plant is provided with a bleaching sequence with three washing devices, possible sequence alternatives could be:

A/D-EOP-D
A/D-EOP-DnD
A/D-EOP-P
D-EOP-D
Z/D-EOP-D
D-EOP-D
A-EOP-D
A/D-EOP-P

As known, the liquid cycle in these cases has been solved such that:

- the last i.e. the D or P stage washer receives circulation water from the pulp drying machine and a small amount of hot water,
- the washing after the middlemost bleaching stage, which in the examples is an EOP-stage (meaning an alkaline extraction stage, wherein peroxide or oxygen can be used if necessary for intensifying the bleaching) uses filtrate from the last washing device of the bleaching and clean water,
- the washing after the first bleaching stage, which in the examples is an A, A/D, Z/D or D stage (meaning an acid, an ozone or dioxide stage or their combination without intermediate washing) uses filtrate from the last washing device of the bleaching and filtrate from an EOP stage.

Although a significant number of bleaching sequences having three washing devices and operating world-wide is close to these or modifications of these, other possible sequences can be formed with three washing devices. Further, it is not essential in the combination, what other bleaching chemicals are used, but what is essential is that the sequence comprises one stage using chlorine-containing chemicals. Additionally, the clean water can also be introduced to a washer of the first bleaching stage. Additionally, the washing devices can be washing presses or just presses, whereby all clean water does not have to be introduced into the process via displacement, but the clean liquid is mixed into the process in dilution.

The bleaching can also comprise four to seven bleaching stages, which all use the earlier mentioned bleaching stages or sequences having at least one chlorine dioxide stage.

If the plant is provided with a bleaching sequence with four washing devices, possible sequence alternatives could be:

ND-EOP-D-D
ND-EOP-D-P
D-EOP-D-D
Z/D-EOP-D-P
D-EOP-D-D
A-EOP-D-P
A/D-EOP-Dn-D

Typically the liquid cycle in these cases has been solved such that:

- the last i.e. the D or P stage washer receives circulation water from the drying machine and a small amount of hot water,
- the last but one washer receives washing water either countercurrently from the last washing apparatus or partly countercurrently so that hot water, evaporation plant condensate or drying machine circulation water is added to be part of the washing water,
- the washing after the second bleaching stage, which in the examples is an EOP stage, uses filtrate from the third or fourth washer of the bleaching and clean water. The amount of clean water can vary and in some embodiments it is not used at all. In some cases, circulation water of the drying machine is used instead of clean water.
- the washing after the first bleaching stage, which in the examples is an A, A/D, Z/D or D stage uses filtrate from the third or fourth washing device of the bleaching and filtrate from an EOP stage.

These examples illustrate the main principles of typical arrangements of the water circulation of bleaching, but several various modifications and connections are found at industrial plants depending on the materials, thermal balance, quality of raw water etc. used in the bleaching. Thus, the examples presented herein are only examples of solutions being the starting point of the planning, of which the most suitable and working solution is adapted for each client.

The solutions presented herein also allow using condensates or effluent in e.g. the production of chlorine dioxide water. As the chlorine dioxide water is typically made in raw water of the mill, the raw water can at some stage be replaced even with purified effluent or condensate. An essential issue is that the liquid in these flows is sufficiently cold. Cooling the condensate to a temperature below 20° C. consumes a lot of energy, but on the other hand it is possible under cold conditions. Economical issues and energy requirement in cooling are decisive in determining whether this kind of water usage is recommendable or not.

Heat exchanger arrangements, by means of which the effluent is cooled and the treated effluent is heated by cross-connected heat exchangers or the treated effluent is heated in digester circulations.

An effluent treatment process shall in the future produce such liquid which is well suitable for use preferably in various objects, dilution after brown stock washing prior to the bleaching plant and possibly e.g. white liquor production. Their quality requirements may differ to such an extent that at the treatment plant the effluents are preferably treated even as separate fractions.

Bleaching chemical consumption remains at essentially the same level as in the best present mill solutions and all targeted brightness levels of the pulp are reached.

As can be noticed from the above, the method and apparatus according to the present invention allow decreasing the emissions of a chemical pulp mill to absolute minimum. Although the above description relates to an embodiment that is in the light of present knowledge considered the most preferable, it is clear to a person skilled in the art that the invention can be modified in many different ways within the broadest possible scope defined by the appended claims alone.

The invention claimed is:

1. A method in the connection of pulp washing at a chemical pulp mill comprising:

alkaline cooking of cellulosic material utilizing cooking liquor for producing brown stock pulp, washing the brown stock pulp in essentially closed successive liquid wash cycles, wherein a washing device in a last of the liquid wash cycles includes at least one of a washing device based on pressing of pulp, a press and a washing press, beaching the washed brown stock using ECF-bleaching, wherein the bleaching includes a first bleaching stage and a discharge for chloride-containing effluents formed during the bleaching, and purifying the chloride-containing effluents with a biological agent, introducing at least 1 $m^3$/adt of the purified chloride-containing effluents as a dilution liquid into the washed brown stock pulp downstream of the last washing device, press or washing press, and the purified chloride-containing effluents flow with the washed brown stock pulp to the first bleaching stage.

2. The method according to claim 1, wherein the first bleaching stage includes at least one of an acid treatment, a D-stage, an ozone stage, an alkaline extraction stage and a peracetic acid stage.

3. The method according to claim 1 wherein the chloride-containing effluents are purified to decrease lignin-content of the effluents.

4. The method according to claim 3 wherein the purification of the chloride-containing effluents comprises a chemical treatment.

5. The method according to claim 1, wherein a washing liquid for washing the brown stock pulp includes at least one of fresh water, evaporation plant condensate and drying machine circulation water.

6. The method according to claim 1, wherein the washing includes oxygen-delignification of the brown stock pulp.

7. The method according to claim 1 wherein a condensate originating from an evaporation plant is used in bleaching as a source of fresh water for the washing of the brown stock.

8. The method according to claim 7, wherein the condensate from the evaporation plant is also used in a pulp drying machine.

9. The method according to claim 1, wherein the chloride-containing effluents are treated in separate fractions, and one of the fractions is treated with the biological agent and another of the fractions is treated with a chemical.

10. The method according to claim 1, wherein oxidized white liquor is used as an alkali source for the bleaching and to neutralize the chloride-containing effluents.

11. The method according to as in claim 1, wherein the chloride-containing effluents upstream of the purification are cooled by the purified chloride-containing effluents.

12. The method according to claim 11, wherein the cooling occurs in a cross-flow heat exchanger through which flows the chloride-containing effluents and the purified chloride-containing effluents.

13. A method for washing pulp at a chemical pulp mill comprising:

alkaline cooking cellulosic material using a cooking liquor and producing a brown stock pulp from the cooking;

washing the brown stock pulp in a series of washing stages, wherein a last of the washing stages includes pressing the brown stock pulp;

bleaching the washed and pressed brown stock pulp with ECF-bleaching and discharging chloride-containing effluents from the bleaching, and purifying the chloride-containing effluents using a biological agent to consume lignin in the effluents;

diluting the washed an pressed brown stock pulp with at least one cubic meter of purified chloride-containing effluents per one ton of air dried pulp (1 $m^3$/adt), wherein the diluted, washed and pressed brown stock pulp with the purified chloride-containing effluents flow to a first process stage of the bleaching step.

14. A method to wash pulp produced in a chemical pulp mill comprising:

producing brown stock pulp in an alkaline cooking process using a cooking liquor;

washing the brown stock pulp in a succession of washing stages;

pressing the washed brown stock pulp in at least a last washing stage of the succession of washing stages;

bleaching the washed brown stock pulp in a ECF-bleaching process which produces bleached pulp and chloride-containing effluents;

purifying the chloride-containing effluents using a biological agent to consume lignin in the chloride-containing effluents, and introducing as a dilution liquid at least one cubic meter of the chloride-containing purified effluents per one ton of air dried pulp (1 $m^3$/adt) to the washed brown stock pulp downstream, in a pulp flow direction, from the last washing device and upstream of a first bleaching stage in the pulp bleaching step.

* * * * *